US007472535B2

(12) United States Patent
Schwartz

(10) Patent No.: US 7,472,535 B2
(45) Date of Patent: Jan. 6, 2009

(54) CORELESS SYNTHETIC YARNS AND WOVEN ARTICLES THEREFROM

(75) Inventor: Larry Schwartz, Boca Raton, FL (US)

(73) Assignee: Casual Living Worldwide, Inc., Louisville, KY (US)

( * ) Notice: Subject to any disclaimer, the term of this patent is extended or adjusted under 35 U.S.C. 154(b) by 82 days.

(21) Appl. No.: 10/838,690

(22) Filed: May 4, 2004

(65) Prior Publication Data

US 2005/0103396 A1 May 19, 2005

Related U.S. Application Data

(60) Provisional application No. 60/520,959, filed on Nov. 18, 2003.

(51) Int. Cl.
*D02G 3/02* (2006.01)
*D02G 3/36* (2006.01)

(52) U.S. Cl. ..... 57/238

(58) Field of Classification Search ..... 57/236–238, 57/243, 244, 248
See application file for complete search history.

(56) References Cited

U.S. PATENT DOCUMENTS

| | | | |
|---|---|---|---|
| D13,544 | S | 1/1883 | Remington |
| D13,545 | S | 1/1883 | Remington |
| 366,743 | A | 7/1887 | Siegenthaler |
| D18,589 | S | 9/1888 | Schuck |
| D30,125 | S | 1/1899 | Moulton |
| 679,978 | A | 8/1901 | Merrick |
| D93,567 | S | 10/1934 | Moore |
| 2,253,000 | A | 8/1941 | Francis |
| 2,313,058 | A | 3/1943 | Francis |
| 2,321,746 | A | 6/1943 | Heymann |
| 2,401,291 | A | 5/1946 | Smith |
| 2,434,532 | A | 1/1948 | Wurzburger |
| D151,042 | S | 9/1948 | Harrison |
| 2,450,948 | A | 10/1948 | Foster |
| 2,713,360 | A | 7/1955 | Bloch |
| 2,721,848 | A | 10/1955 | Vitalis |
| 3,001,354 | A | 9/1961 | Davis |
| 3,012,303 | A | 12/1961 | Whitaker et al. |
| 3,018,610 | A | 1/1962 | Kleinekatopher |
| 3,050,431 | A | 8/1962 | Crandall |

(Continued)

FOREIGN PATENT DOCUMENTS

| | | |
|---|---|---|
| DE | 19516174 | 11/1996 |

(Continued)

OTHER PUBLICATIONS

Kathryn L Hatch, Textile Science, 1993, West Publishing Company, 1st edition, p. 278.*

(Continued)

*Primary Examiner*—Shaun R Hurley
(74) *Attorney, Agent, or Firm*—Lerner, David, Littenberg, Krumholz & Mentlik, LLP

(57) ABSTRACT

A woven panel is formed from a plurality of elongated yarns, with and without a center core. The core yarns provide mechanical strength for the woven material in supporting the coreless yarns when used in load bearing articles such as the seat or back portions of an article of furniture.

23 Claims, 5 Drawing Sheets

U.S. PATENT DOCUMENTS 3,101,522 A 8/1963 Hooper et al.
3,109,278 A 11/1963 Gibson
3,488,934 A 1/1970 MacDonald
3,507,741 A 4/1970 Aleixo
3,559,390 A 2/1971 Staschewski
3,645,819 A 2/1972 Fujii et al.
3,686,845 A 8/1972 Okada et al.
3,691,748 A 9/1972 Buzano
3,691,749 A 9/1972 McKay
3,761,346 A * 9/1973 Caroselli et al. ..... 428/152
3,763,640 A 10/1973 Nagel et al.
3,785,919 A 1/1974 Hickman
3,792,899 A 2/1974 Rocchia et al.
3,803,453 A * 4/1974 Hull ..... 361/220
3,828,544 A 8/1974 Alker et al.
3,839,854 A 10/1974 Carranza et al.
3,867,967 A 2/1975 Rochhia et al.
3,911,186 A 10/1975 Trotman
3,948,702 A 4/1976 Theissen
3,958,406 A 5/1976 Corbiere
4,114,549 A 9/1978 Chambley et al.
4,122,658 A 10/1978 Morioka et al.
4,123,893 A 11/1978 Chambley et al.
4,155,394 A 5/1979 Shepherd et al.
4,164,836 A 8/1979 Tanae et al.
4,168,606 A 9/1979 Callander
4,218,869 A 8/1980 Newton
4,231,834 A 11/1980 Trejo Gonzalez
4,243,713 A 1/1981 Worrall et al.
4,246,747 A 1/1981 Plunkett et al.
4,265,972 A 5/1981 Rudner
4,275,117 A 6/1981 Crandall
4,289,564 A 9/1981 Hanaford et al.
4,295,235 A 10/1981 Deitz
4,378,725 A 4/1983 Hospers et al.
4,395,029 A 7/1983 Davis et al.
4,416,934 A 11/1983 Kimura et al.
4,442,664 A 4/1984 Schmitt et al.
4,467,839 A 8/1984 Westhead
4,469,738 A 9/1984 Himelreich, Jr.
4,475,330 A 10/1984 Kimura et al.
4,495,244 A 1/1985 Phillips
4,544,594 A 10/1985 Li et al.
4,559,772 A 12/1985 Heinrich et al.
4,586,751 A 5/1986 McGuire
4,626,390 A 12/1986 Li et al.
4,628,682 A 12/1986 Buzano et al.
4,639,397 A 1/1987 Sato et al.
4,736,578 A 4/1988 Shaffer
4,744,935 A 5/1988 Priaroggia et al.
4,798,581 A 1/1989 Jessup
4,903,472 A 2/1990 Vanhelle et al.
4,934,008 A 6/1990 McBride Daniel Taylor
5,084,221 A 1/1992 Matsuno et al.
5,091,030 A 2/1992 Nelson
5,094,068 A 3/1992 Hirao
5,200,261 A 4/1993 Taguchi et al.
5,284,380 A 2/1994 Gehry
5,336,562 A 8/1994 Forero et al.
5,442,903 A 8/1995 Lagarrigue et al.
5,507,997 A 4/1996 Evain
5,585,182 A * 12/1996 Aneja et al. ..... 428/398
5,700,490 A 12/1997 Meise
5,704,690 A 1/1998 Schwartz
D395,171 S 6/1998 Schwartz
5,807,794 A 9/1998 Knox et al.
5,829,241 A 11/1998 McAllister et al.
5,834,119 A 11/1998 Roop
5,845,970 A 12/1998 Schwartz
5,858,885 A 1/1999 Hamilton et al.
5,879,792 A 3/1999 Watanabe et al.
D409,001 S 5/1999 Schwartz
5,925,727 A 7/1999 Onda et al.
5,972,514 A 10/1999 D'Herbecourt
6,035,901 A 3/2000 Stumpf et al.
6,074,751 A 6/2000 Murakami et al.
6,117,548 A 9/2000 Swers et al.
6,120,097 A 9/2000 Perry et al.
6,179,382 B1 1/2001 Schwartz
6,209,951 B1 * 4/2001 Han ..... 297/45
6,244,031 B1 6/2001 Murakami et al.
6,264,674 B1 7/2001 Washington et al.
6,426,141 B1 7/2002 Mathis et al.
6,475,047 B2 11/2002 Cynamon
6,601,723 B1 8/2003 Ziglar
6,705,070 B2 3/2004 Schwartz
6,855,420 B2 2/2005 Johnson et al.
6,935,383 B2 8/2005 Schwartz
2001/0039158 A1 11/2001 Swers et al.
2002/0144497 A1 10/2002 Scheunemann
2003/0101708 A1 6/2003 Schwartz
2004/0121684 A1 6/2004 Haun et al.
2005/0009430 A1 * 1/2005 Tsung-Yueh ..... 442/189
2005/0103396 A1 5/2005 Schwartz

FOREIGN PATENT DOCUMENTS

EP 0 073 090 3/1983
EP 0210710 2/1987
EP 03732311 6/1990
FR 796 996 4/1936
GB 1047156 11/1980
GB 2 213 842 8/1989
JP 57133212 8/1982
JP 58098437 A 6/1983
JP 5-93343 4/1993
JP 11179705 7/1999
WO WO-89/12707 12/1989
WO WO 0138629 A1 5/2001

OTHER PUBLICATIONS

Kathryn L. Hatch, Textile Science, 1993 West Publishing Co., 1st Edition, pp. 119-120.
Steven B. Warner, Fiber Science, 1995 Prentice-Hall, Inc., 1st Edition, p. 237.
Technical Data, PVC Plastikote Paint, 2 pages.
COSHH, Material Safety Data Sheet, PVS Plastikote Paint, 3 pages.
Material Safety Data Sheet, 3 pages.
Material Safety Data Sheet, 4 pages.
Material Safety Data Sheet, 6 pages.
Citations from Metals Abstracts (40).
Woven Fiber Furniture, Lloyd Loom, (1991) 5 pages.

* cited by examiner

CORELESS SYNTHETIC YARNS AND WOVEN ARTICLES THEREFROM

CROSS REFERENCES TO RELATED APPLICATIONS

The present invention claims priority from U.S. Application No. 60/520,959, filed Nov. 18, 2003, entitled False Twisted Weave and Articles Made Therefrom, the disclosure of which is incorporated herein by reference.

BACKGROUND OF THE INVENTION

Natural wicker has been used in the manufacture of furniture, baskets and other articles for many centuries. The casual, informal appearance of wicker has made it especially popular for use in enclosed porches and other informal settings in homes, hotels and other establishments. Natural wicker, however, has had limited use in the outdoor furniture market, including patio furniture, pool furniture and the like. This is because natural wicker softens and weakens when wet, and is more susceptible to rotting and mildew than many other natural and man-made furniture materials.

Woven wicker typically comprises a weft yarn, i.e., a yarn running straight through the woven material, and a warp yarn, i.e., a yarn that is woven around the weft yarn. Numerous styles of weave are used in the manufacture of wicker furniture. The various styles of weave result in a different look, feel, strength and weight of the finished woven product. In a simple wave pattern, the weft yarns are spaced apart and arranged parallel to each other. The warp yarns are woven over and under alternating weft yarns. Adjacent warp yarns pass on opposite sides of a given weft yarn.

Polymer yarns have also been used to manufacture wicker-like furniture. By way of example, a polymer yarn is known which is constructed as an elongated body, such as of indeterminate length, having a core surrounded by a sheath of polyvinylchloride (PVC) outer coating, for example, foamed and non foamed PVC material. Foamed PVC material gives greater volume with less material. The outer coating may be formed of other synthetic materials such as polyamides, polyesters and the like. The yarn is typically made in a single step using a coextrusion process, as is known in the art. The inner core may include a single filament of polyester, or may include a plurality of polyester filaments bundled to form a single core. In addition, the core may be formed of other materials than polyester such as metal, monofilament or stranded, such as polyamides and the like. The core is designed to give the yarn greater mechanical strength over yarns formed only of polymer material. This is considered more important when the outer layer is constructed from foamed polymer material.

The polymer yarn being constructed from foamed PVC material results in a lack of uniformity in the foaming of the PVC material during the extrusion process. This produces a yarn which lacks a uniform cylindrical appearance. Specifically, the outer surface of the yarn is deformed, such as by having undulations, mounds and/or depressed areas along the length of the yarn. The deformed shape of the outer surface of the yarn results in the yarn having a more natural look to that of real wicker. It is also known to provide the exterior surface of the polymer yarn with one or more random stripes of a contrasting color and/or one or more random grooves. The stripes and grooves can be continuous and/or intermittent along the exterior surface of the yarn. The yarn, however, can also have a more uniform cylindrical shape, as well as other shapes such as square, oval, flat, triangular and the like. Polymer yarns as thus far described are known from U.S. Pat. Nos. 5,704,690, 5,845,970 and 6,179,382; as well as U.S. Design Pat. Nos. 395,171, 474,614 and 409,001; the disclosures of which are incorporated herein by reference. As in the case of natural wicker, polymer yarns have been woven into a woven material, which has been used in the manufacture of casual furniture suitable for the outdoor furniture market, including patio furniture, as well as for indoor use.

The present invention is broadly directed to the use of polymer yarns having a supporting core woven with polymer yarns without a supporting core. The presence of the core yarn provides the required mechanical strength in the weave to allow greater flexibility in the use of yarns without a supporting core.

SUMMARY OF THE INVENTION

In one embodiment of the present invention, there is described a woven panel comprising a plurality of elongated first yarns of polymer material, the first yarns including an outer sheath of a first polymer material surrounding an elongated center core of a second material; and a plurality of elongated second yarns of polymer material, the second yarns including a body of a third polymer material devoid of a center of a material different from the third polymer material, the plurality of first yarns woven together with the plurality of second yarns to form a woven panel.

In another further embodiment of the present invention, there is described a woven panel comprising a plurality of elongated composite yarns of polymer material, the composite yarns including an elongated first strand having an outer sheath of a first polymer material surrounding an elongated core of a second polymer material and an elongated second strand having an outer sheath of a third polymer material surrounding an elongated core of a fourth polymer material, the first and second strands twisted together over their length; and a plurality of elongated third yarns of polymer material, the third yarns including a body of a fifth polymer material devoid of a center of a material different from the fifth polymer material, the plurality of composite yarns woven together with the plurality of the third yarns to form a woven panel.

In another further embodiment of the present invention, there is described an article of furniture comprising a frame having the shape of an article of furniture, and a woven panel attached to the frame, the woven panel comprising a plurality of elongated first yarns of polymer material, the first yarns including an outer sheath of a first polymer material surrounding an elongated center core of a second material; and a plurality of elongated second yarns of polymer material, the second yarns including a body of a third polymer material devoid of a center of a material different from the third polymer material, the plurality of first yarns woven together with the plurality of second yarns to form a woven panel.

In another further embodiment of the present invention, there is described an article of furniture comprising a frame having the shape of an article of furniture, and a woven panel attached to the frame, the woven panel comprising a plurality of elongated composite yarns of polymer material, the composite yarns including an elongated first strand having an outer sheath of a first polymer material surrounding an elongated core of a second polymer material and an elongated second strand having an outer sheath of a third first polymer material surrounding an elongated core of a fourth polymer material, the first and second strands twisted together over their length, and a plurality of elongated third yarns of polymer material, the third yarns including a body of a fifth polymer material devoid of a center of material different from the fifth polymer material, the plurality of composite yarns woven together with the plurality of the third yarns to form a woven panel.

In another further embodiment of the present invention, there is described a woven panel comprising a plurality of polymer core yarns each having a center core woven together with a plurality of coreless yarns forming a woven panel therefrom.

BRIEF DESCRIPTION OF THE DRAWINGS

The above description, as well as further objects, features and advantages of the present invention will be more fully understood with reference to the following detailed description of Coreless Synthetic Yarns and Woven Articles Therefrom, when taken in conjunction with the accompanying drawings, wherein.

DETAILED DESCRIPTION

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
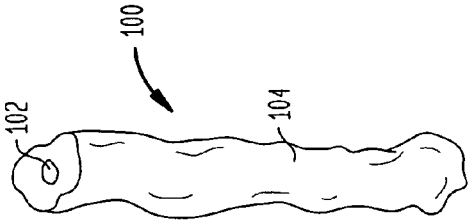
FIG. 1 is a top plan view of a portion of a single strand of a core polymer yarn in accordance with one embodiment.

Referring to the drawings, wherein like reference numerals represent like elements, there is shown in FIG. 1 in accordance with an embodiment of the present invention a single strand of yarn preferably of PVC material of indeterminate length designated generally by reference numeral 100. In the preferred embodiment, the yarn 100 has a core 102 of polyester material or metal as previously described surrounded by a polymer sheath 104 of polymer material such as PVC material. The core 102 may be centered or eccentric within the sheath 104. The yarn 100 may be made as a single strand of polymer material of the type and construction as described in the aforementioned patents which have been incorporated herein by reference. As such, the yarn 100 may have a uniform outer surface and/or cross-section, or one which is deformed along its outer surface and has a non-uniform cross-section over its length, and one in which the outer sheath 104 is foamed or not foamed. However, other sheaths 104 or cores 102 of polymer material of a different construction or polymer material are also contemplated for use in producing a yarn 100 and a weave of woven material in accordance with the present invention.

Figure 2:
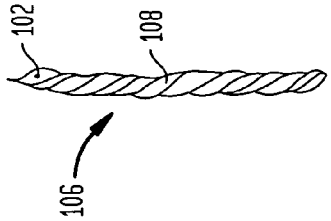
FIG. 2 is a top plan view of a self-twisted core polymer yarn in accordance with another embodiment.

There is shown in FIG. 2 in accordance with another embodiment of the present invention a single strand of yarn preferably of PVC material of indeterminate length designated generally by reference numeral 106. The yarn 106 also has a core 102 of polyester material as previously described surrounded by an outer sheath 106. As such, the yarn 106 may have a uniform outer surface and/or cross-section, or one which is deformed along its outer surface and has a non-uniform cross-section over its length, and one in which the outer sheath 108 is foamed or not foamed. However, other sheaths 108 of polymer material of a different construction or polymer material are also contemplated for use in producing a self-twisted yarn 106 and a weave of woven material in accordance with the present invention. The self-twisted yarn 106 may also be referred to herein as a twisted yarn 106 or a yarn 106.

Yarns 100, 106 can be of any shape, size, surface ornamentation and/or color. For example, the yarns 100, 106 may be flat, oval, square, rectangular, polygonal, etc. It is also contemplated that any variation of the yarns 100, 106 can be utilized in forming a woven portion. By way of one example, the yarn 100, 106 may be co-extruded from polymer material of different colors. In this regard, a portion of the yarn 100, 106 extending longitudally along its length may be one color, and other portions co-extruded of different colors or polymer material. When the yarn 100 is twisted, the varying colors will provide the self-twisted yarn 106 with a unique ornamental appearance of twisted multi-colored yarns notwithstanding that only a single yarn is used. Thus, it is to be understood, that various constructions of polymer yarns 100, 106 as described may be woven to form a woven material having various aesthetic appearances.

Figure 3:
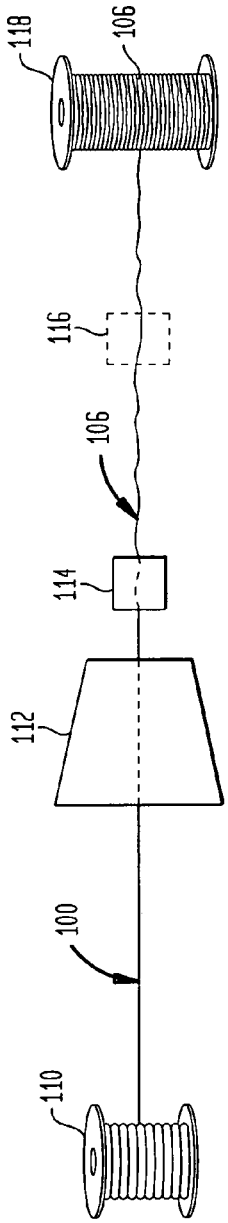
FIG. 3 is a diagrammatic illustration showing one fabrication process for the self-twisted polymer yarn.

Referring now to FIG. 3, there will be described one process of manufacturing a self-twisted yarn 106 from a non-twisted yarn 100. As shown, there is provided a source 110 of a continuous length of a single yarn 100 of polymer material. Generally, the source 110 will be in the nature of a spool of an indeterminate length yarn 100 of the polymer material. It is contemplated, however, that the source 110 can be any apparatus suitable for retaining the yarn 100 and feeding the yarn to conduct the process herein.

The individual yarn 100 may initially be fed from the spool into an oven 112 which is heated to a predetermined temperature. In the case of PVC material, it is contemplated that an oven temperature in one example of about 270° F. will be suitable. The function of heating the yarn 100 is to reduce its memory retention properties so as to inhibit the yarn from untwisting prior to weaving. However, the heating process is not essential or required of the present invention, and if used, can be accomplished at other oven temperatures. The temperature of the oven 112 will generally take into consideration the type of the polymer material forming the yarn 100, as well as the linear rate in which the yarn passes through the oven 112, for example, the residence time in the oven 112. Based upon the oven temperature and residence time of the yarn 100 within the oven 112, the yarn can be heated to a temperature to relieve or reduce its memory properties.

It can be appreciated that the temperature of the oven will vary according to the particular polymer material forming the strand 100, as well as the residence time for the strand within the oven, as well as the degree of memory relief desired of the strand 100. For polymer material most suitable for use in accordance with the present invention, a temperature range of 200 to 450° F., and more preferably about 250 to 375° F. is contemplated. However, as the basis for determining the oven temperature and residence time have been described herein, it is to be understood that other temperatures can be selected for suitable use with any polymer material in which to form a self-twisted strand 106.

As the yarn 100 exits the oven 112, it passes through a conventional twisting apparatus 114. The twisting apparatus 114 is operative for twisting the yarn 100 to form the self-twisted yarn 106 as best shown in FIG. 2. It is well recognized in the art that a twist occurs when the strand is twisted to form either an s-twist or a z-twist. These twists correspond to clockwise and counter-clockwise twists, and one is the mirror image of the other. An s-twisted yarn will look different than a z-twisted yarn in a weave. In the case of a single yarn, the yarn will twist upon itself in a helix, thereby creating either an s-twist or a z-twist, depending upon the twisting direction. The twisting apparatus 114 may be of any suitable construction such as known in the art where continuous lengths of filament are twisted.

The self-twisted yarn 106, if heated, may be subject to air-cooling, or optionally, passed through a cooling device 116. The cooling device 116 may include a source of blowing ambient air, or air chilled to aid in bringing the self-twisted yarn 106 to room or ambient temperature. The resulting yarn 106 is subsequently wound upon a spool 118. It is also contemplated that the twisting apparatus 114 may be positioned before the oven 112, as well as providing an oven to heat the yarn 106 after the yarn is wound on the spool 118. It is also contemplated that the twisting apparatus 114 may be placed directly within the oven 112.

The yarn 100 is formed by hot extrusion of polymer material through a die. It is therefore contemplated that the yarn 100, while in a somewhat heated state after extrusion, may be twisted in the twisting apparatus 114, thereby eliminating the use of a separate oven 112. Depending upon the exit temperature of the yarn 100 from the extruder, the yarn may be allowed to air cool or provided with a separate cooling device 116 for the yarn prior to twisting.

It is contemplated that only a slight heating of the yarn will allow the yarn to relax sufficiently so as to retain its twisted shape after twisting, e.g., 80-100° F. The heating will provide the yarn with sufficient heat to essentially retain its twisted shape. The yarn 106 may be heated prior to or after the twisting operation. In addition, the yarn 106 may be heated as a result of its hot extrusion from an extrusion die during its formation thereby eliminating the need for any subsequent heating as previously described. Although it is preferred that the yarn 106 be heated to reduce some of its memory retention properties, it is not a requirement of the present invention that the yarn 100 be heated prior to weaving the yarn into a woven material for use in an article, such as an article of furniture. In this regard, it is contemplated that the woven material will be heat set in an oven as to be described hereinafter.

Figure 4:
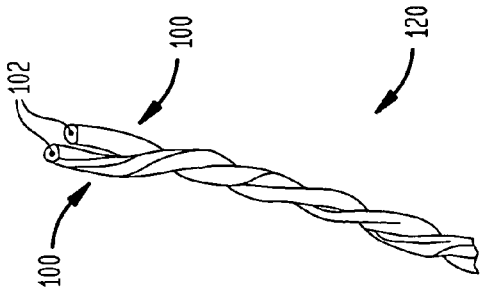
FIG. 4 is a top plan view of a composite yarn formed form twisting multiple core strands together in accordance with another embodiment.

Referring to FIG. 4, there is shown a composite twisted yarn of indeterminate length designated generally by reference numeral 120. The composite yarn 120 is made of two yarns 100 of polymer material and can be of the type and construction as described herein which are twisted together. Although the composite yarn 120 has been illustrated as comprising two yarns 100, it is to be understood that the yarn can be constructed from greater than two yarns if so desired. It is not required that the yarns 100 be identical in size, shape, surface, appearance, coloration and/or surface configuration.

Figure 5:
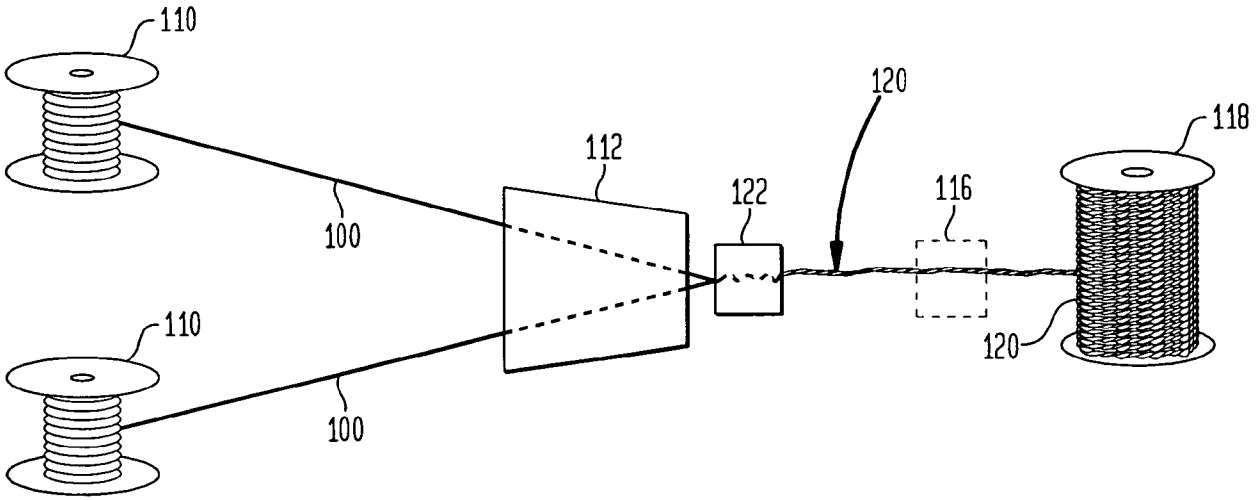
FIG. 5 is a diagrammatic illustration showing one fabrication process for a composite twisted yarn.

Referring now to FIG. 5, there will be described a process of manufacturing a composite twisted yarn 120 in accordance with one embodiment of the present invention, similar to the process of forming the self-twisted yarn 106. As shown, there is provided a source 110 of a continuous length of a yarn 100 of polymer material. A similar source 110 is provided for a continuous length of another yarn 100 of polymer material. Generally, the sources 110 will be in the nature of a spool of an indeterminate length of the yarn 100 of the polymer material.

In accordance with one embodiment, the individual yarns 100 are fed concurrently from the spools into an oven 112 for heating the yarns to a predetermined temperature whereby the memory characteristics of the yarns are reduced or substantially eliminated. It is also contemplated that the yarns 100 can be heated to a sufficient temperature whereby the yarns will soften so as to at least partially adhere to each other over their outer surface upon cooling. The temperature of the yarns 100 to achieve adhesion therebetween will be higher than required to cause the yarns to lose their memory characteristics. The temperature of the oven 112 will take into consideration the type of polymer material forming the yarns 100, as well as the linear rate in which the yarns pass through the oven for example, the residence time in the oven. Although the process has been described as heating both of the yarns 100, it is contemplated to heat only one of the yarns. The other yarn 100 may be at room temperature or heated to a different temperature in a separate oven.

As the heated yarns 100 exit the oven 112, they pass through a conventional filament twisting apparatus 122. The twisting apparatus 122 is operative for twisting the two yarns 100 together to form the composite twisted yarn 120. The twisting apparatus 122 may be of any suitable construction such as known in the rope art where continuous lengths of filaments are twisted together. Sufficiently heating one of the elongated yarns 100 of polymer material causes the yarns upon twisting to at least partially adhere to one another to prevent their unraveling. The twisting process may occur either before or after the heating process. The heating may take place either in an oven 112 or as a result of the yarns 100 being formed by hot extrusion of the polymer material through a die.

It is also contemplated that the spools 110 of the source yarn may be placed in an oven to preheat the yarn 100 to the desired temperature prior to twisting. It is also contemplated that heating may be provided by placing the twisting apparatus 114 in an oven or arrange suitable heaters around the twisting apparatus, or heating the spools 118 of the composite twisted yarn 120.

It is also contemplated that a slight heating of at least one yarn 100 will allow the yarn to relax so as to twist with an additional yarn, and retain its twisted shape upon cooling. However, it is not a requirement that the yarns 100 be heated when making a composite twisted yarn 120. The composite twisted yarn 120 can be heat set after forming a weave therefrom as to be described hereinafter. It is therefore not a requirement that the yarns 100 be adhered to each other along any portion of their length such as by heating at least one of the strands to its softening temperature.

There is disclosed the application of twisted composite yarns for use in manufacturing synthetic woven material for furniture articles in Applicant's U.S. Pat. Nos. 6,625,970 and 6,705,020, the disclosures of which are incorporated herein by reference. These patents disclose various methods of heat setting multiple strand twisted yarns and forming same into a woven material for use in forming, for example, seat and back portions of a furniture article. The twisted yarns are used as both the weft yarns and the warp yarns to form the woven portion, which is adhered to a frame of a furniture article. There is also disclosed the application of multiple strands twisted and single strand non-twisted synthetic yarns for use in manufacturing synthetic woven material for furniture articles in Applicant's co-pending application Ser. No. 10/158,629, entitled "Combination Weave Using Twisted and Non-Twisted Yarn" which was filed on May 30, 2002, the disclosure of which is also incorporated herein by reference.

The yarns 100, 106 have been described as including a core 102. The present invention specifically contemplates the use of a yarn without a core, woven with a yarn 100, 106 having a supporting core. The manufacture of a yarn with a core 102 often results in slower processing speeds with the attendant increased manufacturing cost. In addition, yarns having a core have limitations as to the shape of the yarn. For example, it is not typically possible to produce a flat yarn containing a core. By eliminating the core, additional designs of the yarn can be achieved in the woven material. However, as a coreless yarn generally lacks mechanical strength, it has been discovered that woven panels formed from both coreless and core yarns will provide the necessary strength for use of the woven material in the various articles of furniture and the like as described herein. Previously, it was believed that coreless yarns would not be usable in woven material for certain applications which were load bearing, for example, the seat and backrest portions of an article of furniture.

Figure 7:
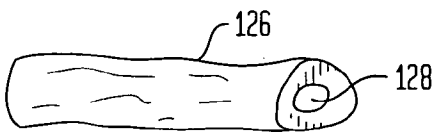
FIG. 7 is a top plan view of a portion of a single strand of coreless polymer yarn in accordance with another embodiment.
Figure 6:
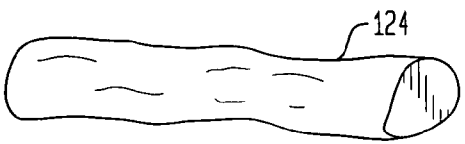
FIG. 6 is a top plan view of a portion of a single strand of coreless polymer yarn in accordance with one embodiment.

As shown in FIG. 6, a coreless yarn 124 may be similar in construction to yarn 100, except for the elimination of the core 102, i.e., having a solid polymer core of the same yarn material. Referring to FIG. 7, coreless yarn 126 is similar to yarn 124, but includes a hollow region 128 or void. The hollow region 128 is devoid of any material. By having a hollow region 128, the coreless yarn 126 may be described as having a body devoid of a core of a material different from the material forming the yarn, as the hollow region is not considered a material, rather a void or the absence of any material. As such, it is contemplated that during the weaving process, the yarn 126 will have a tendency to flatten at certain locations, providing the weave with a different appearance. The hollow region 128 may be of various sizes and will typically extend along the entire length of the yarn 126, and may be centered or off-centered within the yarn 126.

Figure 8:
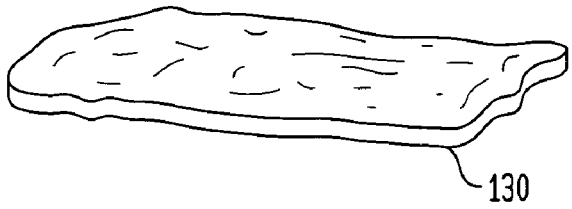
FIG. 8 is a top plan view of a portion of a single strand of coreless polymer yarn in accordance with another embodiment.

Referring to FIG. 8, there is shown a flat coreless yarn 130. By flat, it is meant that the yarn 130 has a thickness to width ration of greater than about 1:2. However, the thickness to width ratio can be as large as desired, for example, 1:5, 1:10, 1:15, etc. The ratio will be dictated by the aesthetic effect desired by the weave resulting form the use of the coreless yarn 130 in combination with yarns having a core 102. It is to be understood that the yarns 124, 126, 130, as yarn 100, may be uniform or non-uniform, may be of any color or multiple colors, and may be of any size. The coreless yarn 130 may also have one or more hollow regions 128 which may be centered or off-centered within the yarn. It is also contemplated that the yarns 124, 126, 130 can be formed from foamed PVC material such that the yarns have a deformed outer surface and a non-uniform cross-section over their entire length. It is also contemplated that other polymers may be used to form the yarns 124, 126, 130, such as polyester and the like.

There will now be described the use of a core yarn 100, 106 and a coreless yarn 124, 126, 130 in forming a woven portion. In accordance with one embodiment, a plurality of core yarns, twisted or non twisted, are woven with a plurality of coreless yarns to form a woven material for forming portions of an article. It is to be understood that furniture items such as couches, chairs, awning material, tables, benches, stools, trunks, mats and the like can be produced in accordance with the teachings of the present invention. It is understood that other combinations and constructions of core yarns 100, 106 and coreless yarns 124, 126, 130 can be utilized in forming the weave for such an article. Any variation of furniture type and yarn material is contemplated.

Figure 9:
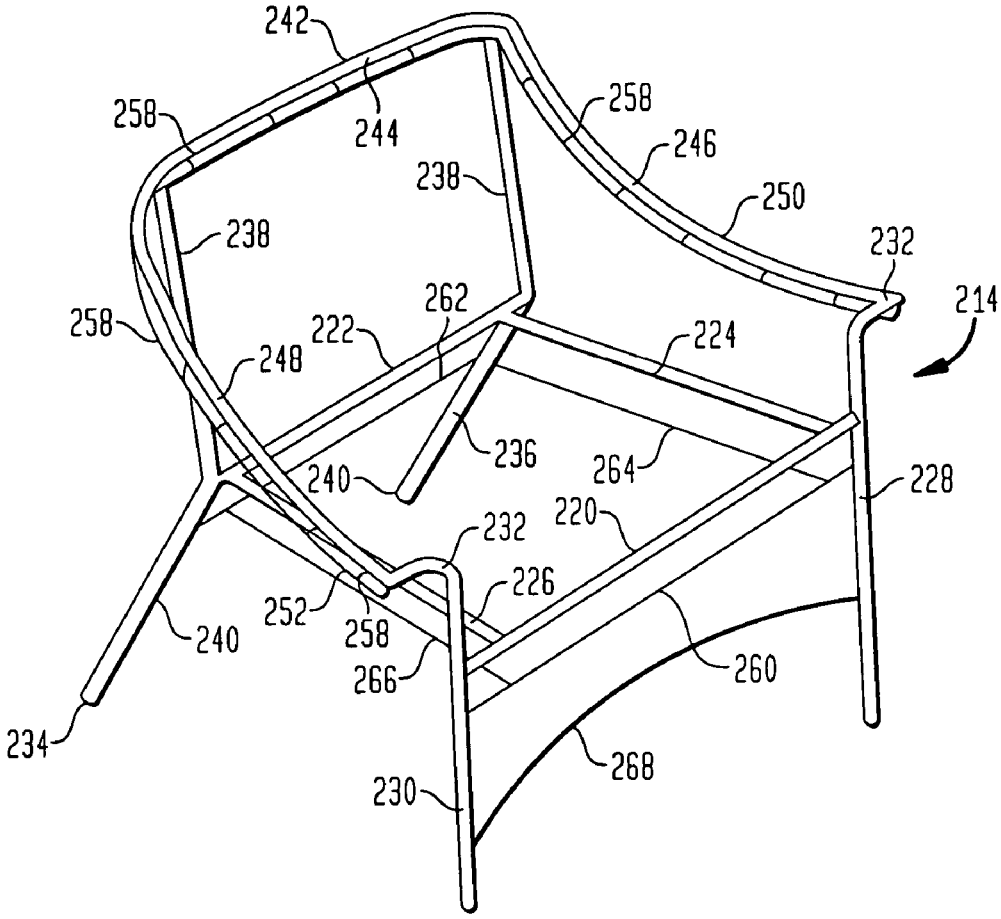
FIG. 9 is a perspective view of a skeletal frame of an article of furniture.
Figure 10:
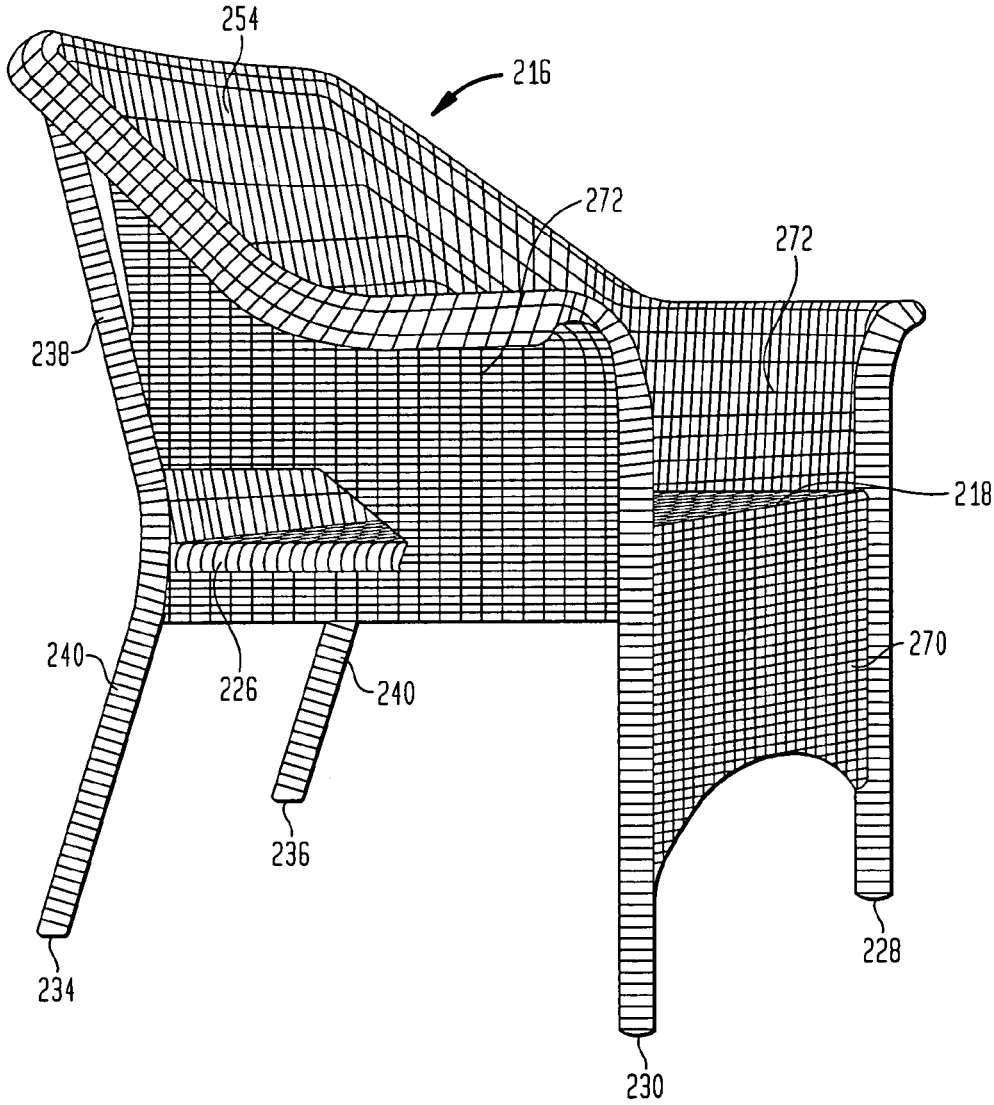
FIG. 10 is a perspective view of an article of furniture including a woven portion of polymer yarn; and, FIG. 11 is a top plan view of woven material constructed by weaving polymer yarn strands in accordance with an embodiment of the present invention.

As shown in FIGS. 9 and 10, a chair can be produced from a rigid skeletal frame 214 which will be covered with a weave of woven material produced from a composite weave of yarns of the present invention. The frame 214, by way of illustration only, provides an arm chair with a seat, a back rest, a pair of front legs, a pair of back legs and a pair of side arms. The seat 218 (see FIG. 10) is delineated by a connecting front member 220, a parallel spaced apart back member 222 and a pair of parallel spaced apart side members 224, 226. The front legs 228, 230 are constructed as parallel spaced apart vertical members joined to the free ends of the front member 220 and have outwardly turned extensions 232 providing the front legs with an L-shape. The front legs 228, 230 are arranged generally vertical to the floor as viewed from the front and side of the chair 216.

The back legs 234, 236 are constructed from an angular member attached to the free ends of the back member 222. The back legs 234, 236 have generally parallel spaced apart upper members 238 extending vertically from the back member 222 as viewed from the front and side and generally parallel spaced apart lower members 240. The lower members 240 are arranged at a rearwardly extending angle as viewed from the side and extend generally vertical from the back member 222 as viewed from the rear of the chair 216.

A generally U-shaped member 242 includes a center section 244 connected across the free ends of the upper members 238 of the back legs 234, 236 and a pair of curved spaced apart side arm members 246, 248 forming the side arms 250, 252 of the arm chair. The free ends of the side arm members 246, 248 are attached to the free ends of the extensions 232 of the respective front legs 228, 230. The side arm members 246, 248 are spaced apart wider at their mouth where they connect to the extensions 232 than where they form the center section 244. This arranges the side arms 250, 252 outwardly of the side members 224, 226. The upper members 238 of the back legs 234, 236, the back member 222 and center section 244 delineate the back 254 of the chair 216.

A secondary frame can be used to provide attachment support for the woven material utilized in covering the frame 214. Specifically, a generally U-shaped elongated rod 256 having a shape conforming substantially to the shape of the U-shaped member 242 is connected thereto in underlying relationship by means of a plurality of spaced apart ribs 258. Another secondary support frame is positioned between the front and back legs 228, 230, 234, 236 underlying the seat 218. This secondary frame is constructed from a front rod 260 connected between the front legs 228, 230, a back rod 262 connected between the back legs 234, 236 and a pair of side rods 264, 266 arranged in parallel spaced apart relationship connected between the front rod 260 and back rod 262 inwardly of their terminal ends. An additional front rod 268 may be positioned between the front legs 228, 230 underlying front rod 260.

Figure 11:
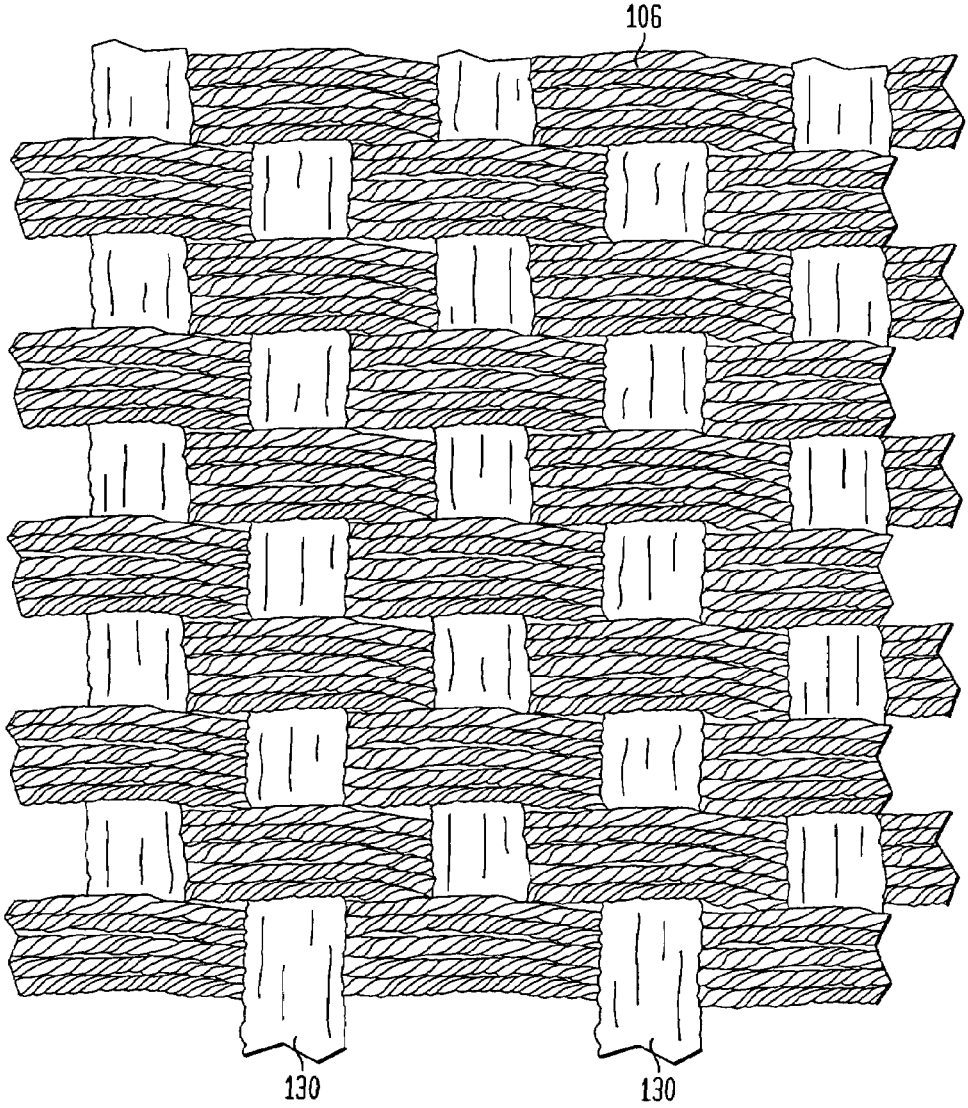

Referring now to FIGS. 10 and 11, the frame 214 is covered by weaving, for example, the yarns 106, 130 into a woven material to form panels of woven material directly on the frame. The chair 216 is fabricated by weaving any of the yarns as described in any combination into woven material which is attached to the frame 214. As shown, the chair 216 includes a seat portion 218, a front skirt portion 270, a back rest portion 254 and side portions 272. The front and back legs 228, 230, 234, 236 may be wrapped with a continuous length of yarn. A plurality of individual yarns 106, 130 are attached to various portions of the frame 214, for example, to the secondary frame as previously described.

In one embodiment, a plurality of individual self-twisted yarns 106 are woven with individual flat yarns 130, as they are attached to the frame 214 into a predetermined weave pattern. Some yarns are the weft yarn, while others are the warp yarn, as previously discussed. It is also contemplated that non-twisted yarn 100 and other types of yarn, for example, twisted composite yarns 120 and/or multiple twisted yarns, and those disclosed in the aforementioned applications and patents can be woven together to form such woven material with the coreless yarns 124, 126, 130.

By combining yarns of various appearance and characteristics, various aesthetic and textural effects can be obtained. The self-twisted yarns 106 can form the weft or warp yarns in the woven material. Similarilty, the coreless yarns 124, 126, 130 can form the weft or warp yarns in the woven material. As such, the core 102 in the core yarns 100, 106 will provide the necessary physical strength for the resulting woven material.

It is contemplated that the core yarns 100, 106 by virtue of their core 102 will provide sufficient strength for the woven material formed therefrom, notwithstanding the absence of a core within the coreless yarns 122, 124, 130. Generally, it is contemplated that the core yarns 100, 106 will run in the warp direction in the woven material, while the coreless yarns 122, 124, 130 will run in the weft direction, however, this is not a requirement of the present invention. It is further contemplated that a mixture of coreless and core yarns forming the weft and/or warp yarns can be woven into a woven material.

It is known that the individual yarns can shift within the weave during use of the chair 216. Heat setting the woven material on the chair 216 aids in preventing the yarns from shifting within the different portions of the chair. The entire chair 216 with the woven portion attached can be placed into an oven similar to oven 112 in order to heat set the attached woven material similar to that used in the production of the composite twisted yarn 120. In the case of the chair 216, it is contemplated that the oven will be a batch oven, as opposed to a continuous oven 112 as described with respect to the manufacture of the composite twisted yarn 120. In this regard, the oven will typically be of sufficient size to hold a plurality of chairs 216. The chairs 216 will remain in the oven 112 at a predetermined temperature for a predetermined residence time to cause the yarns to heat set whereby contiguous portions of the yarn may bond together within the weave when the chair is removed from the oven and allowed to cool.

The heat setting process stabilizes the weft and warp yarns to inhibit their shifting within the weave, as well as heat setting individual yarns which may be used as the weft and warp yarns. It has been discovered that heat setting of the woven material using certain polymer yarns causes the woven material to sag thereby detracting from the aesthetic appeal of the article. By using self-twisted yarns 106 as either the weft or warp yarns, either alone or in combination with other yarns as described herein, it has been discovered that sagging is substantially eliminated during the heat setting process of the woven polymer material.

Although in accordance with the preferred embodiment, the woven material is formed in situ on the frame, it is contemplated that panels of pre-woven material may be adhered to the frame and subsequently heat set by placing the article of furniture in an oven as thus far described. It is therefore contemplated that portions of the article of furniture may be formed with woven material in situ, other portions by attaching panels of pre-woven material thereto, as well as variations thereof. In any event, the article of furniture can be placed in an oven to heat set the woven material. It is also contemplated that pre-woven material may be placed in an oven for heat setting, prior to adherence to the article of furniture, thereby doing away with the need to heat set the entire article of furniture.

Although the invention herein has been described with reference to particular embodiments, it is to be understood that these embodiments are merely illustrative of the principles and application of the present invention. It is therefore to be understood that numerous modifications may be made to the illustrative embodiments and that other arrangements may be devised without departing from the spirit and scope of the present invention as defined by the appended claims.

The invention claimed is:

1. An article of furniture comprising a frame having the shape of an article of furniture, and a woven panel attached to said frame, said woven panel comprising a plurality of elongated first yarns, said first yarns including an outer sheath of a synthetic first polymer material surrounding an elongated non-conductive weight-supporting core of a synthetic second polymer material, wherein said first polymer material is different from said second polymer material; and a plurality of elongated second yarns, said second yarns including a body of a synthetic third polymer material, said second yarns having a solid non-conductive cross-section of said third polymer material, said plurality of first yarns woven together with said plurality of second yarns to form said woven panel;

wherein said first yarns having a non-conductive weight-supporting core provide greater mechanical strength to said woven panel than said second yarns having a solid cross-section of said third polymer material which is different than said second polymer material.

2. The article of claim 1, wherein at least one of said first yarns comprises a twisted yarn.

3. The article of claim 1, wherein said first and third polymer materials are the same polymer material.

4. The article of claim 1, wherein each of said plurality of first yarns comprises a twisted yarn.

5. The article of claim 1, wherein said first yarns have a deformed outer surface and a non-uniform cross-section over its entire length.

6. The article of claim 1, wherein said first yarns have a flat shape.

7. The article of claim 1, wherein said first yarns comprise at least a pair of polymer strands twisted together to form a composite twisted yarn.

8. The article of claim 1, wherein said first yarns comprise warp yarns and said second yarns comprise weft yarns.

9. The article of claim 1, wherein said plurality of first yarns are at least partially adhered to said plurality of second yarns.

10. An article of furniture comprising a frame having the shape of an article of furniture, and a woven panel attached to said frame, said woven panel comprising a plurality of elongated composite yarns of synthetic polymer material, said composite yarns including an elongated first strand having an outer sheath of a synthetic first polymer material surrounding an elongated non-conductive weight-supporting core of a synthetic second polymer material, wherein said first polymer material is different from said second polymer material, and an elongated second strand having an outer sheath of a synthetic third polymer material surrounding an elongated non-conductive weight-supporting core of a synthetic fourth polymer material, said first and second strands twisted together over their length, and a plurality of elongated third yarns of synthetic polymer material, said third yarns including a body of a synthetic fifth polymer material, said third yarns having a solid non-conductive cross-section of said fifth polymer material, said plurality of composite yarns woven together with said plurality of said third yarns to form said woven panel;

wherein said first and second strands having a non-conductive weight-supporting core provide greater mechanical strength to said woven panel than said second yarns having a solid cross-section of said fifth polymer material which is different than said second and fourth polymer material.

11. The article of claim 10, wherein said body of said third yarns have a thickness to width ratio greater than 1:2.

12. The article of claim 10, wherein said first yarns have a flat shape.

13. The article of claim 10, wherein said first and third polymer material are the same polymer material.

14. The article of claim 10, wherein said second and fourth polymer materials are the same polymer material.

15. The article of claim 10, wherein said first, third and fifth polymer materials are of the same polymer material.

16. The article of claim 10, wherein said fifth polymer material is different from one of said first and third polymer materials.

17. The article of claim 10, wherein said body of said third yarns have a thickness to width ratio greater than about 1:5.

18. The article of claim 10, wherein said first and second strands each have a deformed outer surface and a non-uniform cross-section over their entire length.

19. The article of claim 10, wherein said composite yarns comprise weft yarns and said third yarns comprise warp yarns.

20. The article of claim 10, wherein said composite yarns comprise warp yarns and said third yarns comprise weft yarns.

21. The article of claim 10, wherein said plurality of first strands are at least partially adhered to said plurality of second strands.

22. The article of claim 10, wherein said plurality of composite yarns are at least partially adhered to said plurality of said third yarns.

23. The article of claim 10, wherein said third yarns have a region of said fifth polymer material.

* * * * *